US010211542B2

(12) United States Patent
Yanagisawa et al.

(10) Patent No.: US 10,211,542 B2
(45) Date of Patent: Feb. 19, 2019

(54) ANTENNA DEVICE AND METHOD FOR MANUFACTURING SAME

(71) Applicant: YOKOWO CO., LTD., Tokyo (JP)

(72) Inventors: Wasuke Yanagisawa, Tokyo (JP); Hirotoshi Mizuno, Gunma (JP); Yasushi Shirakata, Kanagawa (JP); Yoshio Aoki, Kanagawa (JP)

(73) Assignee: YOKOWO CO., LTD., Tokyo (JP)

( * ) Notice: Subject to any disclaimer, the term of this patent is extended or adjusted under 35 U.S.C. 154(b) by 73 days.

(21) Appl. No.: 15/126,068

(22) PCT Filed: Feb. 20, 2015

(86) PCT No.: PCT/JP2015/054795
§ 371 (c)(1),
(2) Date: Sep. 14, 2016

(87) PCT Pub. No.: WO2015/141386
PCT Pub. Date: Sep. 24, 2015

(65) Prior Publication Data

US 2017/0104275 A1 Apr. 13, 2017

(30) Foreign Application Priority Data

Mar. 18, 2014 (JP) ..... 2014-055422

(51) Int. Cl.
*H01Q 21/06* (2006.01)
*H01Q 9/38* (2006.01)
(Continued)

(52) U.S. Cl.
CPC ..... *H01Q 21/061* (2013.01); *H01Q 1/3275* (2013.01); *H01Q 1/362* (2013.01);
(Continued)

(58) Field of Classification Search
CPC ..... H01Q 21/061; H01Q 1/3275; H01Q 1/48
(Continued)

(56) References Cited

U.S. PATENT DOCUMENTS 8,816,917 B2 8/2014 Ueno
2010/0123559 A1* 5/2010 Wilkinson ..... G06K 7/0008 340/10.4
(Continued)

FOREIGN PATENT DOCUMENTS

JP 59183502 A 10/1984
JP 01165206 A 6/1989
(Continued)

OTHER PUBLICATIONS

Interantional Search Report for corresponding PCT Application No. PCT/2015/054795, 4 pages, dated Apr. 7, 2015.

*Primary Examiner* — Hai V Tran
(74) *Attorney, Agent, or Firm* — Matthew B. Dernier, Esq.

(57) ABSTRACT

Provided is an antenna device having a structure that suppresses deterioration in performance as a profile becomes lower. Four FM band antenna elements and two AM band antenna elements are arranged side by side on an antenna base. Further, a circuit board including synthesis circuits in one-to-one correspondence with the antenna elements, respectively, is arranged in an inner space of the antenna elements. In order that omnidirectionality may be exhibited in a horizontal plane, each of the antenna elements includes a helically wound linear conductor, and a planar conductor that is electrically connected to the linear conductor at a part substantially the farthest from a ground plane (antenna base).

10 Claims, 12 Drawing Sheets

(51) Int. Cl.

| | |
|---|---|
| ***H01Q 21/30*** | (2006.01) |
| ***H01Q 1/32*** | (2006.01) |
| ***H01Q 1/36*** | (2006.01) |
| ***H01Q 1/38*** | (2006.01) |
| ***H01Q 1/48*** | (2006.01) |

(52) U.S. Cl.
CPC ..... *H01Q 1/38* (2013.01); *H01Q 1/48* (2013.01); *H01Q 9/38* (2013.01); *H01Q 21/30* (2013.01)

(58) Field of Classification Search
USPC ..... 343/893, 700 MS, 702
See application file for complete search history.

(56) References Cited

U.S. PATENT DOCUMENTS

| | | | | |
|---|---|---|---|---|
| 2013/0342405 | A1 | 12/2013 | Ueno | |
| 2014/0248846 | A1* | 9/2014 | Yanagisawa | H03F 3/193 455/234.1 |
| 2015/0048995 | A1* | 2/2015 | Andrenko | H01Q 21/00 343/893 |

FOREIGN PATENT DOCUMENTS

| | | | |
|---|---|---|---|
| JP | 10242731 | A | 9/1998 |
| JP | 11355031 | A | 12/1999 |
| JP | 2012161075 | A | 8/2012 |
| JP | 2013106146 | A | 5/2013 |

* cited by examiner

FIG. 5A
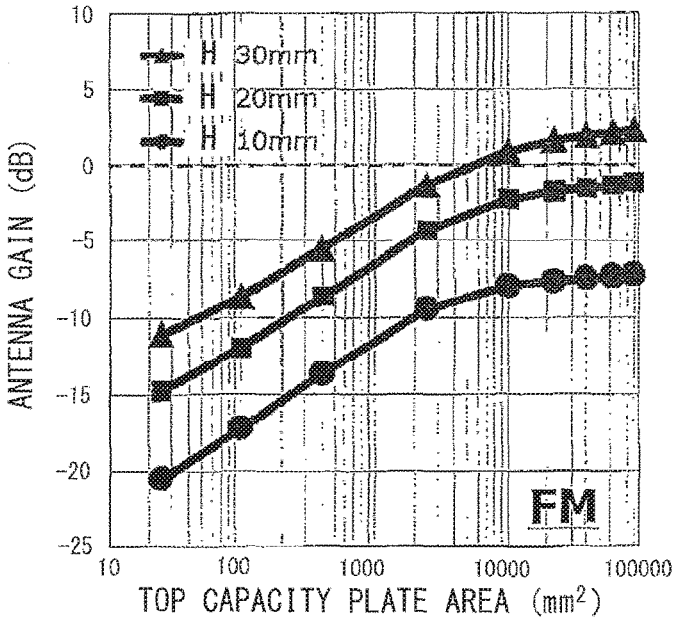
FIG. 5B
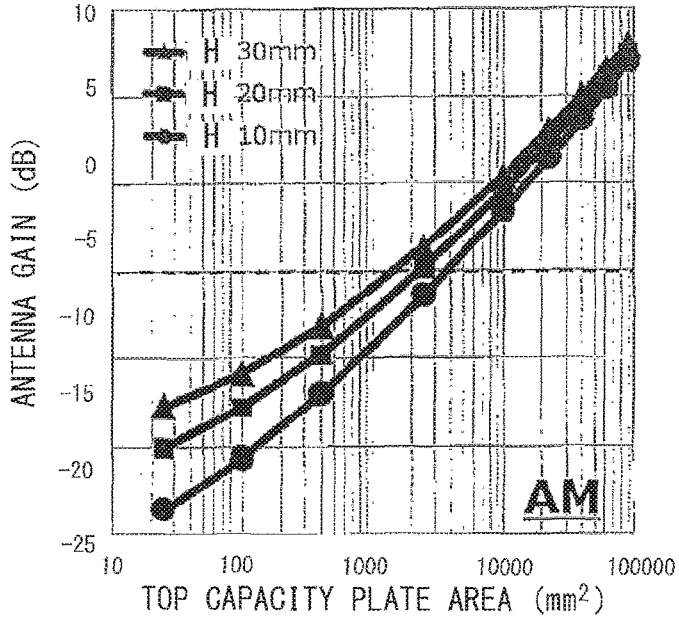
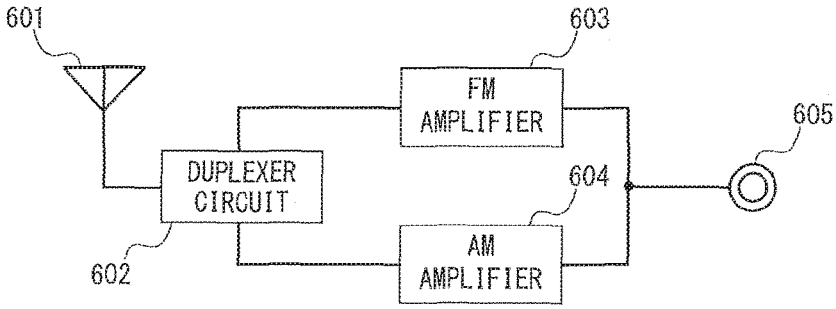
FIG. 6

ANTENNA DEVICE AND METHOD FOR MANUFACTURING SAME

TECHNICAL FIELD

The present invention relates to a low profile antenna device mountable on, for example, a vehicle body, and a method of manufacturing the antenna device.

BACKGROUND ART

Antenna devices disclosed in, for example, Patent Literature 1 and Patent Literature 2 are antenna devices for an FM band and for an AM band mountable on a vehicle body. In the antenna device disclosed in Patent Literature 1, an antenna base and an antenna element including two kinds of helical antenna portions are arranged in a shark fin antenna case. The antenna element includes a first helical portion closer to the antenna base and a second helical portion farther from the antenna base. The first helical portion is formed of a rail-like pattern or a plate-like conductive member. Meanwhile, the second helical portion has a surface area per unit length that is larger than that of the first helical portion, and is formed of a linear pattern, a solid pattern, a solid pattern and wire, or a plate-like conductive member bent so as to be substantially U-shaped (oblong helical element).

Further, in the antenna device disclosed in Patent Literature 2, the antenna element includes a helical antenna element and a plate-like element. The antenna element is wound about a virtual axis extending from an antenna base toward a top portion of an antenna device for a vehicle. The plate-like element is a conductive plate, and is arranged on an open end side of the helical antenna element so as to cover the top portion while being electrically connected to the open end side of the helical antenna element and so as to have, with the virtual axis, a positional relationship of intersecting each other perpendicularly or obliquely.

CITATION LIST

Patent Literature

[PTL 1] JP 2012-161075 A, [PTL 2] JP 2013-106146 A

SUMMARY OF INVENTION

Technical Problem

The antenna device disclosed in Patent Literature 1 mainly focuses on functioning the entire antenna element as an antenna with efficiency in a limited space. However, in such an antenna device, two kinds of helical portions are arranged in a height direction at a predetermined interval. In particular, when the second helical portion is formed of a plate-like conductive member, a planar portion thereof is upright with respect to the antenna base in the so-called vertically oriented structure. Therefore, there is a limit to the extent of a low profile, and only a height of about 70 mm can be realized.

The antenna device disclosed in Patent Literature 2 has low profile and can secure a substantially constant antenna gain over a wide band due to an effect of a plate-like element mounted on a tip of the antenna element. However, this antenna device includes the single antenna element and the plate-like element, and thus, there is a limit to the extent of a high gain of the antenna. For example, in order to secure an antenna gain equivalent to that of the related-art shark fin antenna, a height of 50 mm or more is necessary.

In view of the circumstances described above, it is an object of the present invention to provide an antenna device having a structure that can maintain an antenna gain and other kinds of antenna performance equivalent to those of the related-art antenna device even when the profile of the antenna device is lower than the above-mentioned heights. It is another object of the present invention to provide a method of manufacturing the above-mentioned antenna device.

Solution to Problem

According to one embodiment of the present invention, there is provided an antenna device, including: an antenna device, comprising: an antenna base having a planar portion at a ground potential in operation; and n antenna elements, where n is a natural number equal to or larger than 2, the antenna elements being arranged on the antenna base so as to exhibit omnidirectionality on a plane in parallel with the planar portion, and being configured to receive or transmit the same signal at the same time, wherein each of the n antenna elements includes: a linear conductor having both end portions arranged in directions away from the planar portion; and a planar conductor, which is electrically connected to one end portion of the linear conductor, at a part, at which the one end portion is substantially the farthest from the planar portion, and which is opposed to and substantially in parallel with the planar portion, and wherein another end portion of the linear conductor is electrically separated from another end portion of a linear conductor of another antenna element.

According to one embodiment of the present invention, there is provided a method of manufacturing an antenna device, including the stages of: dividing an area of a planar portion in which antenna elements are to be arranged into k pieces, where k is a natural number equal to or larger than 2, based on a relationship between a height of the antenna elements and an antenna gain secured by the area; and arranging side by side, on the planar portion, k planar conductors each having a divided area and a linear conductor having one end electrically connected to corresponding one of the k planar conductors at a part substantially the farthest from the planar portion and another end electrically connected to an amplifier circuit of k lines of amplifier circuits at a part substantially the nearest to the planar portion, such that omnidirectionality is exhibited on a plane in parallel with the planar portion, wherein k antenna elements configured to receive or transmit the same signal is formed on the planar portion.

Advantageous Effects of Invention

The antenna device according to the present invention includes the planar conductor opposed to and substantially in parallel with the planar portion at the ground potential in operation. Since a capacity to ground is secured by the planar conductor, the band becomes wider and the antenna gain is improved. In addition, the plurality of antenna elements each having such a planar conductor are arranged on the antenna base so as to exhibit omnidirectionality within a plane in parallel with the planar portion, to thereby further improve the antenna gain. Thus, even when the antenna has a small height from the ground plane, reduction of the antenna gain and the like accompanying the small height of the antenna can be compensated for.

BRIEF DESCRIPTION OF DRAWINGS

FIG. 5A is a graph for showing a relationship between the top capacity plate area and an antenna gain of each of the first embodiment and an antenna device for comparison, and is for the case of an FM band.

FIG. 5B is a graph for showing a relationship between the top capacity plate area and an antenna gain of each of the first embodiment and an antenna device for comparison, and is for the case of an AM band.

FIG. 6 is a block diagram of an electronic circuit mounted on a circuit board of the related-art antenna device.

DESCRIPTION OF EMBODIMENTS

Now, embodiments of the present invention are described with reference to the drawings.

[First Embodiment]

In a first embodiment of the present invention, a case is described in which the present invention is applied to a low profile antenna device that can be used in an FM band (from 76 MHz to 108 MHz) and in an AM band (0.520 MHz to 1.710 MHz) as an example. The antenna device is mounted, for example, on a vehicle roof and used thereon, and exhibits omnidirectionality in a horizontal plane.

Figure 1:
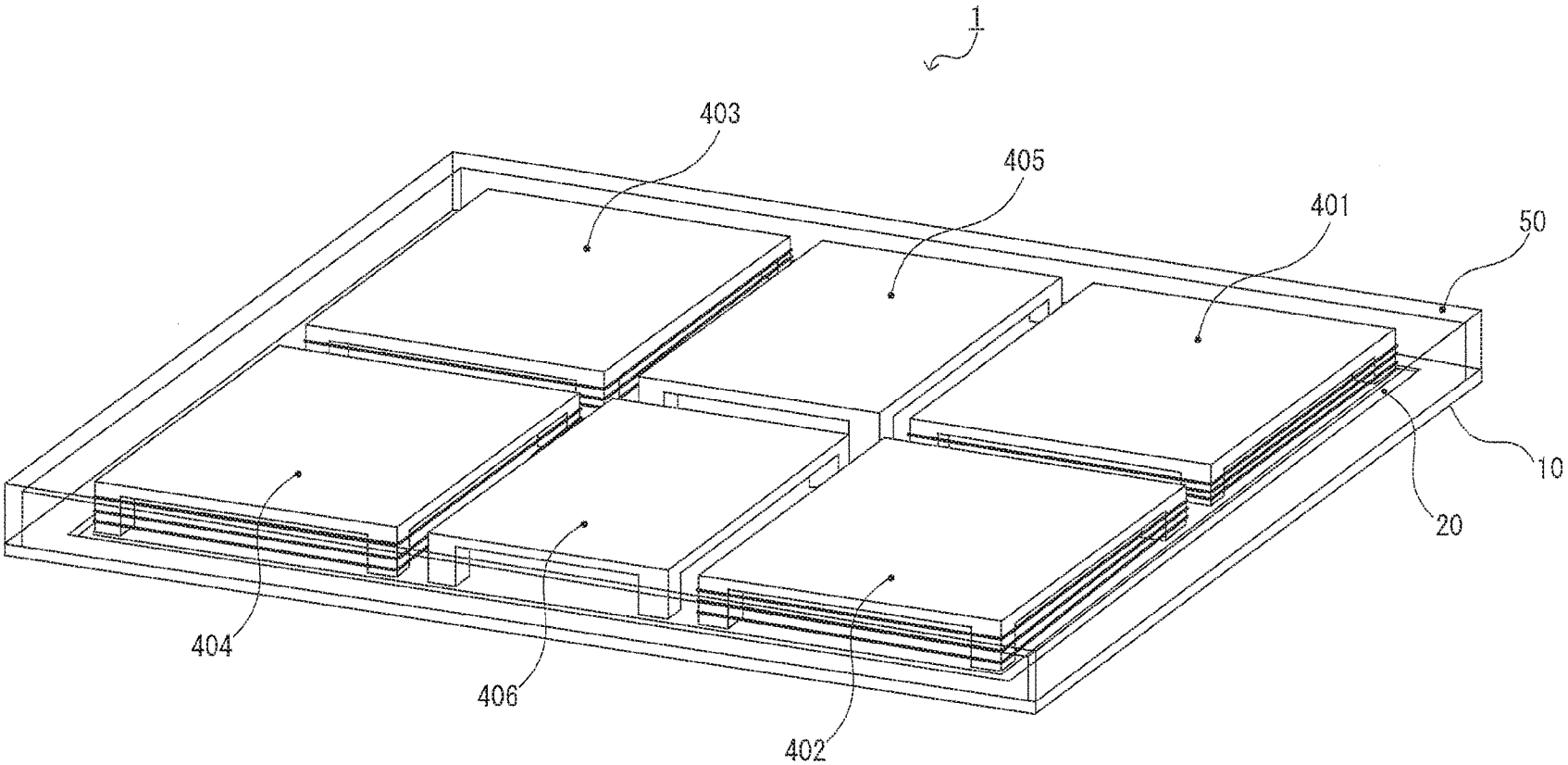
FIG. 1 is an external perspective view of an antenna device according to a first embodiment of the present invention.
Figure 2:
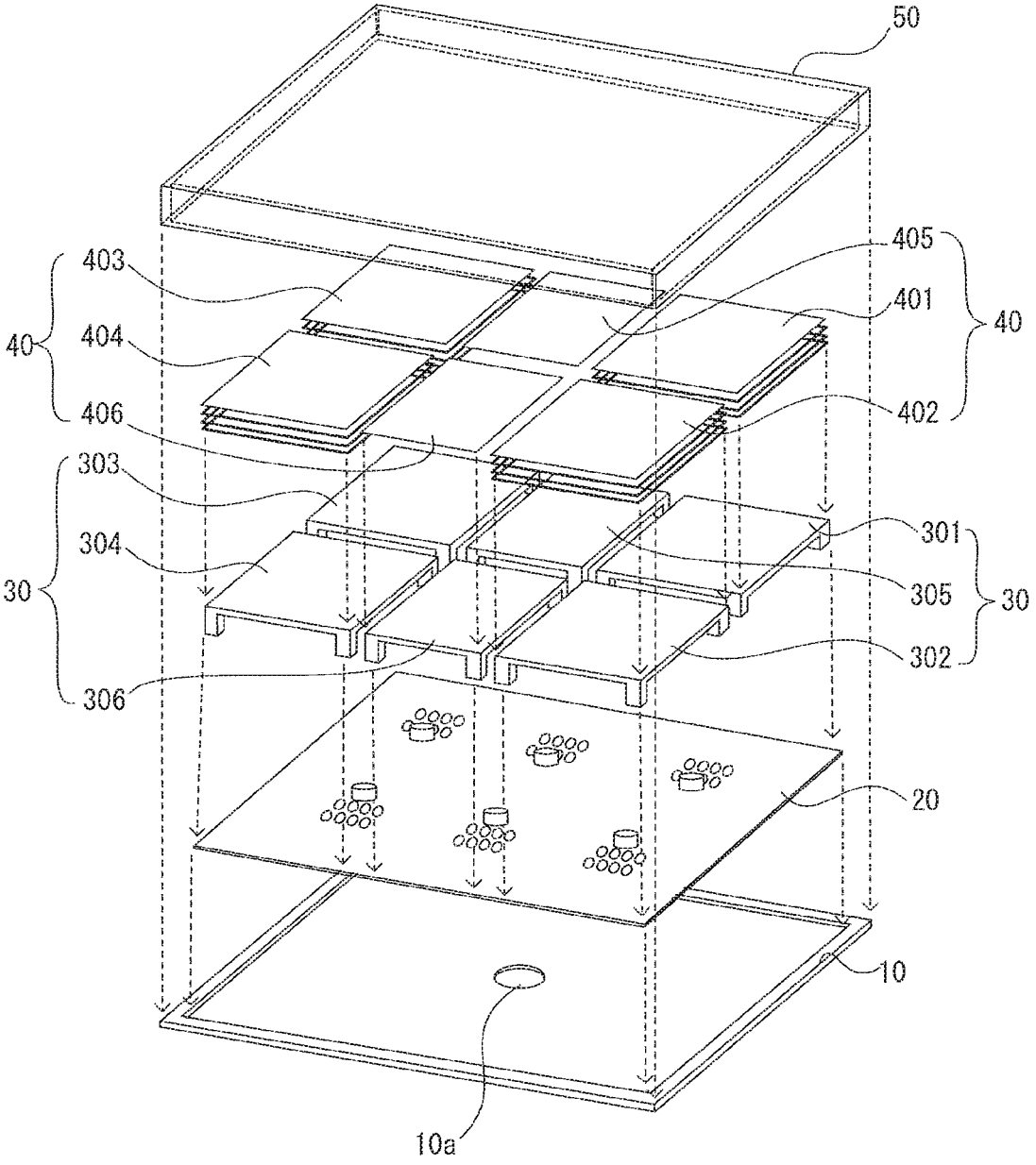
FIG. 2 is an exploded view of the antenna device according to the first embodiment.

FIG. 1 is an external perspective view for illustrating the exemplary structure of an antenna device according to this embodiment, and FIG. 2 is an exploded perspective view thereof. An antenna device 1 includes an antenna base 10 formed of a metal member, such as aluminum die cast. The antenna base 10 is a component for mounting the antenna device 1 on a vehicle roof, and has an upper surface (direction opposite to a bottom surface toward the vehicle roof, the same applies to the following), which has formed thereon a planar portion that is electrically connected to the vehicle roof at a ground potential in operation ("antenna mounting planar portion") and a cover joining portion for watertightly joining a cover portion 50 thereto.

The antenna base 10 is in the shape of a square with four sides each having a length of 160 mm. The antenna mounting planar portion is formed so as to have the area of 22,500 $mm^2$ (=150 mm×150 mm) in a region that is slightly recessed from the cover joining portion on the outer periphery of the antenna base 10.

The antenna mounting planar portion has a thickness of about 0.5 mm, and the cover joining portion has a thickness of about 1.0 mm.

A mounting hole 10*a* for inserting a mounting mechanism (not shown in the drawings) for mounting the antenna device 1 on a vehicle roof is formed substantially in the center of the antenna mounting planar portion. A circuit board 20 is arranged on the antenna mounting planar portion. The circuit board 20 has a thickness of about 0.5 mm.

The circuit board 20 is one resin substrate having an electronic circuit mounted thereon. Specifically, a substrate surface is partitioned into six, each of which has formed therein an amplifier circuit including an antenna feeding terminal and an amplifier electrically connected via a wiring pattern. In other words, six lines of amplifier circuits are formed. Further, on the circuit board 20, also formed thereon one synthesis circuits configured to synthesize output signals (amplified signals) of the respective lines and an output terminal for transmitting an output of the synthesis circuit to an external device.

Six element supports 301 to 306 (referred to as element supports 30 when there is no need to distinct the element supports) are arranged side by side on an upper surface of the circuit board 20. "Arranged side by side" means being arranged in the same plane without an overlap.

The element supports 301 to 306 are formed of dielectric blocks or the like, and support corresponding antenna elements 401 to 406 (referred to as antenna elements 40 when there is no need to distinct the antenna elements), respectively.

Each of the element supports 30 has, when formed of a dielectric block, a top portion opposed to and in parallel with the antenna base 10 and a frame extending downward (direction toward the circuit board 20, the same applies to the following) from the outer periphery of the top portion. The top portion may be a surface having an opening, and the frame may be a combination of a plurality of columns.

A portion surrounded by the frame of each of the element supports 30 is a hollow space. Circuit components protruding from the circuit board 20 are housed in the hollow space.

This can reduce the size of the entire antenna device. A helical groove is formed in an outer surface of the frame at a predetermined pitch.

Each of the antenna elements 40 includes a linear conductor, and a planar conductor for securing a capacity to ground. The planar conductor is, for example, a mesh-like or plate-like conductor in the shape of a rectangular flat plate having the area that is approximately equal to that of the top portion of the element support 30 (area of the top portion surrounded by the outer periphery thereof) and a thickness of 0.2 mm (hereinafter referred to as "top capacity plate").

According to this embodiment, four FM band antenna elements 401 to 404 and two AM band antenna elements 405 and 406 are arranged side by side. Each of the top capacity plates of the FM band antenna elements 401 to 404 has the area of 3,500 $mm^2$ (=70 mm×50 mm). Each of the top capacity plates of the AM band antenna elements 405 and 406 has the area of 2,800 $mm^2$ (=70 mm×40 mm).

A gap of from 5 mm to 10 mm is provided between the adjacent antenna elements 40. In other words, as a whole, the six antenna elements 40 are arranged side by side in an antenna mounting planar portion of 22,500 $mm^2$. The reason of the area is described later.

One end portion of the linear conductor having both end portions is electrically connected to the top capacity plate at a part substantially the farthest from the antenna base 10. "A part substantially the farthest" means a part at a height at which the highest earth capacity can be secured. The other end portion of the linear conductor is connected to the antenna feeding terminal (not shown in the drawings) formed in the circuit board 20.

The linear conductor for the FM band is, for example, a copper wire having a diameter of 0.4 mm wound several times in the groove on the outer periphery of the frame of each of the element supports 30, that is, a helical coil wound at predetermined intervals (pitch). The copper wire is fitted into the groove in the frame, and thus, by forming the groove to have a depth corresponding to the diameter of the copper wire, a helical diameter of the copper wire becomes approximately the same as an outer diameter of the top capacity plate. The helical diameter and the pitch are adjusted so as to produce resonance at a frequency in the FM band.

When the linear conductor is a helical coil, it is desired that winding directions of adjacent copper wires (helical coils) be opposite to each other. This causes currents flowing through the copper wires to be in phase with each other. Thus, compared with a case in which currents in different phases flow through the copper wires, coupling between the antenna elements is suppressed to suppress deterioration in antenna performance.

It is enough that a linear conductor for the AM band can secure a specific inductance component, and thus, the linear conductor is not necessarily required to be a helical coil. However, in the case of a helical coil, it is desired that winding directions be opposite to each other.

Figure 3A:
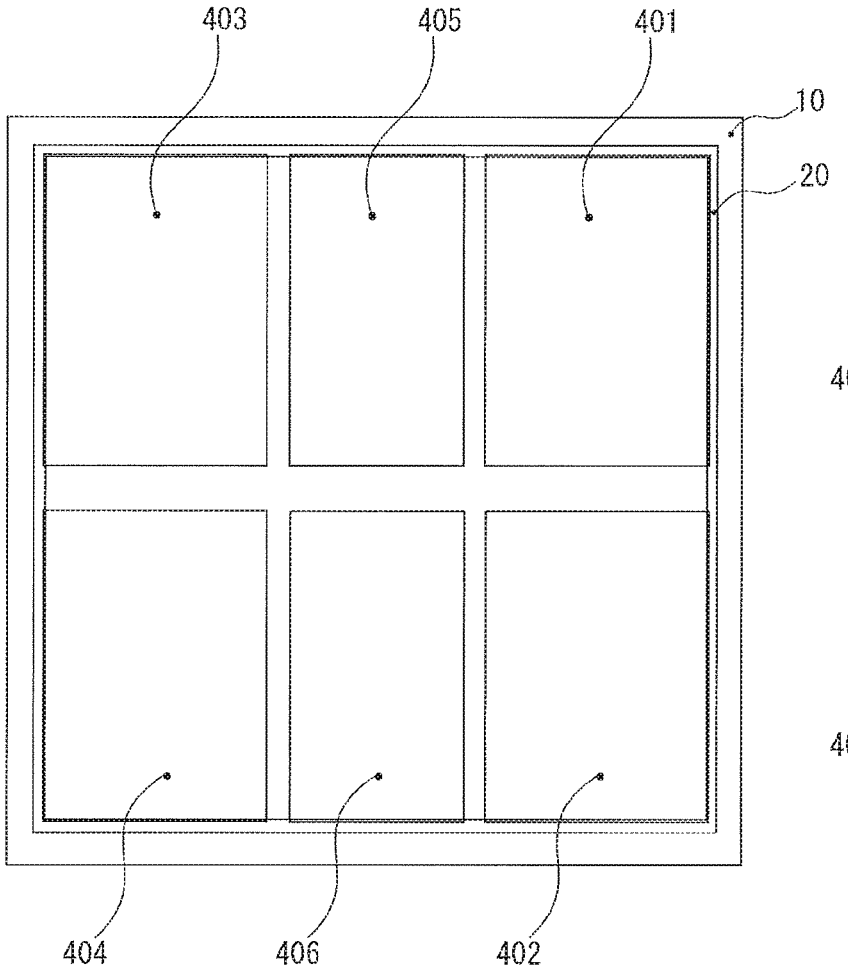
FIG. 3A is a front view of an antenna body portion in the antenna device according to the first embodiment.
Figure 3C:
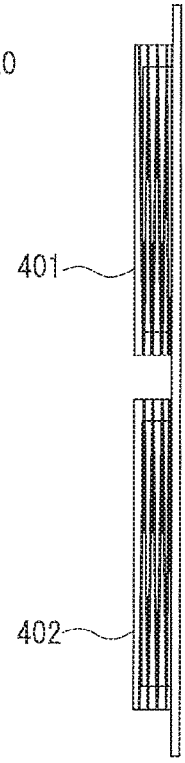
FIG. 3C is a side view of an antenna body portion in the antenna device according to the first embodiment.
Figure 3B:
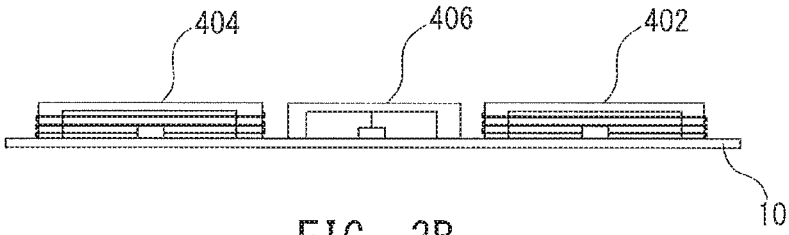
FIG. 3B is a side view of an antenna body portion in the antenna device according to the first embodiment.

FIGS. 3A-3C are illustrations of an outer appearance of a portion of the assembled antenna device from which the cover portion 50 is removed. FIG. 3A is a top view, and FIG. 3B and FIG. 3C are side views thereof. As illustrated in FIG. 3A, each of the top capacity plates of the antenna elements 40 is a substantially rectangular flat plate, and is formed into the same shape and size as those of the top portion of the element support 30 protruding from the antenna base 10. Therefore, the top capacity plate is opposed to and in parallel with the antenna mounting planar portion of the antenna base 10. Further, the top capacity plate secures the capacity to ground in operation.

The top capacity plate is a rectangular flat plate in the illustrated case. However, from the viewpoint of securing necessary electrical performance, the top capacity plate is not necessarily required to be a rectangular flat plate, and may be a flat plate in the shape of a circle, a polygon, a ring, a mesh, a combination of a ring and a lattice, or other shapes. In this case, the shape of the top portion of the element support 30 conforms to the shape of the top capacity plate.

The cover portion 50 covers the antenna base 10, the circuit board 20, and the antenna elements 40, and is watertightly joined to the cover joining portion formed on the outer periphery of the antenna base 10. The cover portion 50 is formed of, for example, a radio wave transmitting synthetic resin, and is formed into the shape of a box. The color of the cover portion 50 may match the color of the vehicle body (in FIG. 1, for the sake of convenience of description, the cover portion 50 is formed of a translucent resin). Further, the cover portion may have not a single structure but a double structure.

Figure 4:
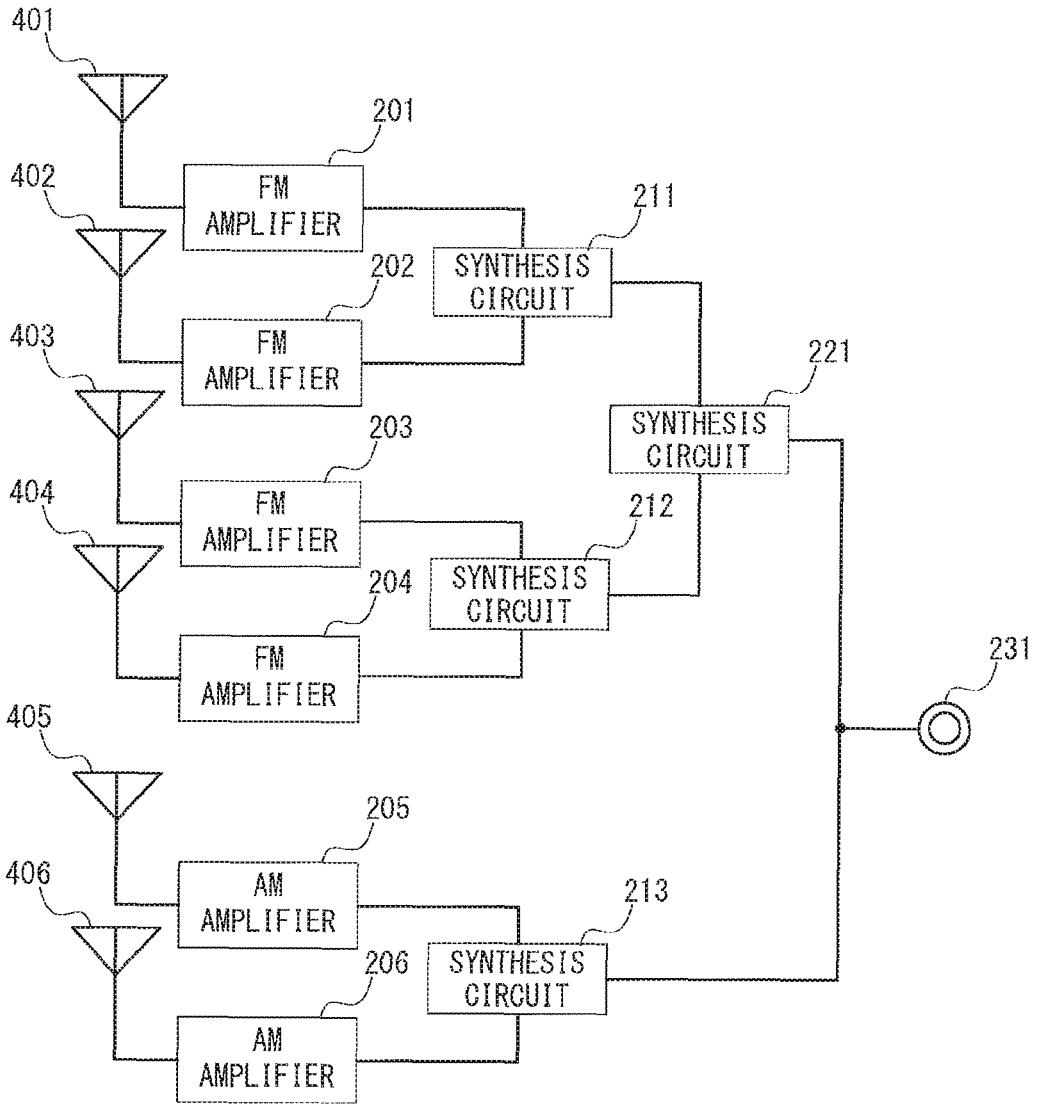
FIG. 4 is a block diagram of an electronic circuit mounted on a circuit board.

FIG. 4 is an illustration of the exemplary structure of the electronic circuit mounted on the circuit board 20. Signals received by the FM band antenna elements 401 to 404 are input to FM amplifiers 201 to 204 in one-to-one correspondence with the antenna elements 401 to 404, respectively, to be amplified. Output from the FM amplifier 201 and output from the FM amplifier 202 are synthesized by a synthesis circuit 211. Output from the FM amplifier 203 and output from the FM amplifier 204 are synthesized by a synthesis circuit 212. Output from the synthesis circuit 211 and output from the synthesis circuit 212 are further synthesized by a synthesis circuit 221.

Signals received by the AM band antenna elements 405 and 406 are also input to AM amplifiers 205 and 206 in a pair with the antenna elements 405 and 406, respectively, to be amplified. Output from the AM amplifier 205 and output from the AM amplifier 206 are synthesized by a synthesis circuit 213. Output from the synthesis circuit 221 and output from the synthesis circuit 213 are output to an output terminal 231.

A band-pass filter, an automatic gain controller (AGC), or the like are added to the electronic circuit as appropriate.

Here, the FM amplifiers 201 to 204 are described in detail. It is preferred that an amplifying element in the first stage of each of the FM amplifiers 201 to 204 be an element that attains low noise in a wide frequency range of, for example, from 76 MHz to 108 MHz. Specifically, an element that attains a minimum noise figure Fmin of 0.2 dB or less and an equivalent noise resistance Rn of 4Ω or less in the received frequency band is preferred. Such elements include, for example, a high electron mobility transistor (HEMT) manufactured of a GaAs-based, InP-based, GaN-based, or Si—Ge-based compound semiconductor. An HEMT is a field effect transistor (FET) using high mobility two-dimensional electron gas induced by semiconductor heterojunction as a channel, and is an element that is generally used in a high frequency band above the FM band.

An HEMT is used in this embodiment because in operation, a high priority is given to achieve a substantially constant noise figure (hereinafter referred to as "NF") in an entire desired frequency band when connected to an antenna element, rather than pursuit of input/output impedance matching. NF is an index expressed as a ratio between a signal-to-noise ratio (Si/Ni) in input to the amplifier and a signal-to-noise ratio (So/No) in output from the amplifier. As NF becomes smaller, lower noise characteristics are attained.

As the AM amplifiers 205 and 206, taking into consideration 1/f noise, that is, noise that attenuates at 3 dB/octave being noise in a low frequency band, not HEMTs but ordinary FETs or bipolar transistors are used.

Next, antenna performance of the antenna device 1 according to this embodiment is described in detail.

It is well known that, as a distance to an antenna element farthest from the plane at the ground potential, that is, the height of the antenna element becomes smaller, the matching frequency range between an electronic circuit connected to the antenna element and the antenna element becomes smaller. It is also well known that antenna gain is proportional to the second power of the height.

In the antenna device 1 according to this embodiment, the matching frequency range that becomes smaller as the profile of the antenna element becomes lower is enlarged through an increase of the area of the top capacity plate to secure the capacity to ground. The antenna gain that is reduced as the profile becomes lower is compensated for by receiving the same signal by a plurality of antenna elements (with the increased areas of the top capacity plates as described above) and synthesizing the received signals after being amplified. The amplification may be performed after the synthesis. With this, practical antenna performance can be obtained even when the profile is low. The reason is described below.

FIGS. 5A and 5B are characteristics diagrams for showing the relationship between the area of the top capacity plate and the antenna gain when the height (H) of the antenna elements 40 having the structure described above is changed to 10 mm, 20 mm, and 30 mm. "Height" as used herein means a distance from the antenna mounting planar portion at the ground potential to the top capacity plate. FIG. 5A is for the case of the FM band, and FIG. 5B is for the case of the AM band. In each of the figures, the horizontal axis denotes the top capacity plate area in $mm^2$ and the vertical axis denotes the antenna gain in dB. The antenna gain dB is an average gain in the band.

The characteristics diagrams are calculated using "HFSS", which is a three-dimensional electromagnetic field simulator manufactured by ANSYS, Inc. For comparison purposes, an antenna gain of an antenna device both for the FM band and for the AM band having a height from the plane at the ground potential (corresponding to the antenna mounting planar portion) of 60 mm and the top capacity plate area of 10×40 (=400) $mm^2$ is used as a reference (0 dB). Such an antenna device is referred to as a "reference antenna" for the sake of convenience.

When, while the top capacity plate area is kept 400 $mm^2$, the profile becomes lower from 60 mm to 30 mm, 20 mm, and 10 mm, the antenna gain becomes lower accordingly. For example, in the cases shown in FIG. 5A and FIG. 5B, when the height is as small as 10 mm, the antenna gain becomes approximately 1/36, that is, −15 dB both for the FM band and for the AM band.

On the other hand, with regard to all the heights, as the top capacity plate area becomes larger, the matching frequency range becomes wider and the antenna gain can be improved.

However, although, as the top capacity plate area becomes larger, the antenna gain is improved more for the AM band, the extent of improvement in antenna gain is decreased for the FM band when the top capacity plate area is approximately 3,500 $mm^2$. This means that, when a space for housing the antenna element is limited as in an antenna device mounted on a vehicle, a sufficient antenna gain cannot be secured simply by increasing the area more than necessary.

According to this embodiment, the antenna elements are not shared between the FM band and the AM band, and the FM band antenna elements and the AM band antenna elements are independent of each other. In order to secure the top capacity plate area of 3,500 $mm^2$ for each of the FM band antenna elements 401 to 404, the top capacity plates have a long side of 70 mm and a short side of 50 mm. Through use of the top capacity plates of the four antenna elements 401 to 404 described above, the antenna gain can be improved by 6 dB. Specifically, even when the height from the antenna mounting planar portion is as small as 10 mm, the difference in antenna gain with the reference antenna having a height of 60 mm can be reduced to about −9 dB. However, even when the area is about 90% of the above (3,000 $mm^2$), the difference in antenna gain described above is about −9.5 dB, and top capacity plates having such a size can also be used.

In the case of the AM band, through use of top capacity plates having a long side of 70 mm and a short side of 40 mm (=2,800 $mm^2$), even when the height from the antenna mounting planar portion is as small as 10 mm, the difference in antenna gain with the reference antenna having a height of 60 mm can be reduced to −3 dB. However, even when the area is about 90% of the above (2,500 $mm^2$), the difference in antenna gain described above is about −4 dB, and top capacity plates having such a size can also be used.

Further, through obtainment of an output signal by arranging the antenna elements 401 to 404 with the top capacity plates having the areas described above in one-to-one correspondence with the amplifiers 201 to 204 and synthesizing the amplified signals of the amplifiers 201 to 204, the antenna gain can be improved by four times (6 dB) for the FM band and by two times (3 dB) for the AM band.

With this, the antenna gain in the FM band can be improved from −9 dB to −3 dB. The antenna gain can be enhanced compared with a case in which one antenna element having the same area is used. Specifically, the area when the four antenna elements 401 to 404 each having a top capacity plate of 70 mm×50 mm are arranged side by side is 14,000 $mm^2$. When one antenna element forms a top capacity plate having such an area, as is clear from the graph of FIG. 5A for the case when the height is 10 mm, the antenna gain is −7.5 dB. Therefore, even when the area is the same, when the four antennas are used, the gain becomes higher by 4.5 dB.

As can be seen from FIG. 5A and FIG. 5B, when, in the limited area of the antenna mounting planar portion, the individual top capacity plate areas are attempted to be reduced from the size described above to increase the number of the antenna elements, and the number of amplifiers corresponding thereto is attempted to be increased, the antenna gain may become lower as the top capacity plate becomes smaller, and loss of the synthesis circuits becomes larger, and thus, sufficient antenna performance cannot be obtained as a whole. Therefore, there is a limit to the number of the antenna elements.

Meanwhile, when the antenna elements have a height of 20 mm or 30 mm, the number of antenna elements and amplifiers corresponding thereto can be reduced.

Next, a mechanism of improving the antenna performance on the electronic circuit side is described.

The related-art low profile antenna device for the FM band and the AM band mounted on a vehicle typically has the structure illustrated in FIG. 6 because a space for housing the antenna element and the like is limited (the same can be said with regard to the reference antenna described above). Specifically, in the related-art antenna device, one antenna element 601 is used both for the FM band and for the AM band. After received signals are separated into FM band signals and AM band signals by a duplexer circuit 602, the FM band signals are input to an FM amplifier 603 and the AM band signals are input to an AM amplifier 604. An output from the FM amplifier 603 and an output from the AM amplifier 604 are guided to an external electronic device via an output terminal 605.

However, the duplexer circuit 602 is a combination of a high-pass filter and a low-pass filter using a lumped constant, and thus, it is generally difficult to completely separate the FM band signals and the AM band signals. As a result, part of the FM band signals flow into the AM amplifier. Similarly, part of the AM band signals flow into the FM amplifier. Therefore, energy of the received signals is partly lost. As a result, energy of signals at the output terminal 605 is not a sum of the output from the FM amplifier 603 and the output from the AM amplifier 604.

Meanwhile, in the antenna device 1 according to this embodiment, the FM band antenna elements 401 to 404 and the AM band antenna elements 405 and 406 are used. FM band signals are independently amplified by the FM amplifiers 201 to 204, whereas AM band signals are independently amplified by the AM amplifiers 205 and 206, and after that, synthesis is performed on the resultants by the respective synthesis circuits 211 to 213 and 221. Therefore, a signal-to-noise ratio (S/N) is improved, which leads to improvement in antenna gain.

This is described taking a pair of antenna elements as an example. The S/N of one antenna element and one amplifier is expressed by the following expression.

$$So/No=GSi/(GNi+Na) \quad (1)$$

In Expression 1, So represents an output signal, No represents output noise, Si represents an input signal, Ni represents input noise, Na represents amplifier noise, and G represents an amplification gain.

The output signal So is simply the input signal Si multiplied by G, while the output noise No is the input noise Ni multiplied by G with the noise Na caused by the amplifier added thereto. In this case, when two pairs of the antenna element and the amplifier are connected in parallel, the input signal Ni and the input noise No are both addition of the same values, and are thus simply the sum total. However, the noises Na caused by the amplifiers are random and are not related to each other. Therefore, the result is not simply the sum total, and is the square root of the sum of the mean squares, i.e., $\sqrt{2}Na$.

Specifically, the S/N when two pairs of the antenna element and the amplifier are connected in parallel is expressed by the following expression.

$$So/No=2GSi/(2GNi+\sqrt{2}Na) \quad (2)$$

When Expression (1) and Expression (2) are compared with each other, it can be seen that the output S/N is larger in Expression (2) (parallel connection).

According to actual measurements by the inventors of the present invention, it was found that, by omitting the duplexer circuit 602 illustrated in FIG. 6 and connecting in parallel the FM band antenna elements 401 to 404 and the amplifiers 201 to 204, and the AM band antenna elements 405 and 406 and the amplifiers 205 and 206, the antenna gain was able to be improved by 3 dB each.

Figure 7A:
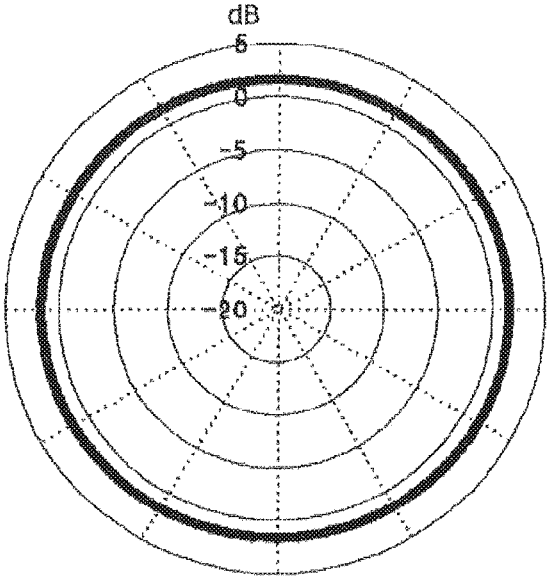
FIG. 7A is a graph for showing directional characteristics of the antenna device according to the first embodiment, and is for the case of the FM band.
Figure 7B:
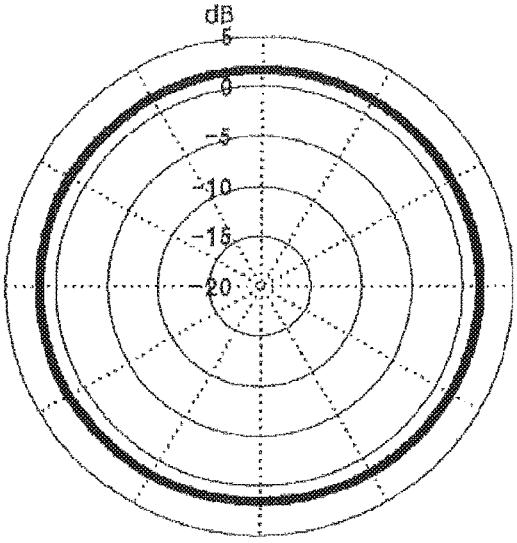
FIG. 7B is a graph for showing directional characteristics of the antenna device according to the first embodiment, and is for the case of the AM band.

FIG. 7A and FIG. 7B are graphs for showing directional characteristics in the horizontal plane for the case of the FM band and for the case of the AM band, respectively. With the antenna elements 40 having the structure illustrated in FIG. 1 to FIG. 3C, substantially the same receiving sensitivity can be obtained omnidirectionally both for the FM band and for the AM band. In other words, the antenna device 1 according to this embodiment is omnidirectional in a plane in parallel with the antenna mounting planar portion.

Therefore, electromagnetic waves can be omnidirectionally received without arranging, for example, directional antenna elements in a plurality of directions.

As described above, the antenna device 1 according to this embodiment was able to improve the antenna gain by about 6 dB by setting the top capacity plate area of each of the FM band antenna elements 401 to 404 to 3,150 $mm^2$ or more, preferably 3,500 $mm^2$ or more, by 6 dB by arranging the four FM band antenna elements 401 to 404 in the same plane, and further, by 3 dB by omitting the duplexer circuit. In other words, it was found that the antenna performance equivalent to that of the reference antenna having a height of 60 mm was able to be maintained even when the profile was as low as 10 mm.

Further, the antenna device 1 according to this embodiment was able to improve the antenna gain by about 12 dB by setting the top capacity plate area of each of the AM band antenna elements 405 and 406 to 2,520 $mm^2$ or more, preferably 2,800 $mm^2$ or more, by 3 dB by arranging the two AM band antenna elements 405 and 406 in the same plane, and by 3 dB by omitting the duplexer circuit. In other words, it was found that the antenna performance equivalent to or more than that of the reference antenna having a height of 60 mm was able to be maintained even when the profile was as low as 10 mm.

[Second Embodiment]

Next, an embodiment of the present invention is described in which the basic structure as an antenna device for the FM band and for the AM band is the same as that of the first embodiment and the height of the antenna elements, that is, the distance from the antenna mounting planar portion to the top capacity plate is larger than that of the antenna device 1 according to the first embodiment. Names of structural elements of the antenna device and the like are similar to those in the first embodiment.

As can be seen from the characteristics diagrams of FIG. 5A and FIG. 5B, when the antenna element has a height that is larger than 10 mm, the top capacity plate area for compensation can be reduced, that is, the area of the antenna mounting planar portion can be reduced. Accordingly, in a second embodiment of the present invention, a case is described in which the antenna element has a height of 20 mm and the antenna mounting planar portion has the area of 10,000 $mm^2$ (=100 mm×100 mm) as an example.

Figure 8A:
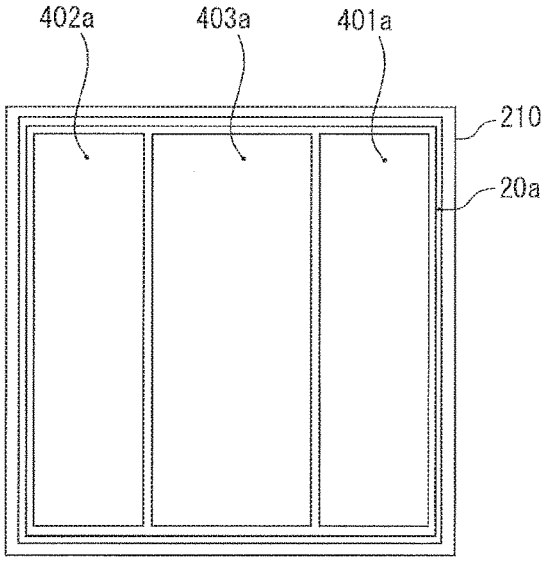
FIG. 8A is a front view of an antenna body portion in an antenna device according to a second embodiment of the present invention.
Figure 8C:
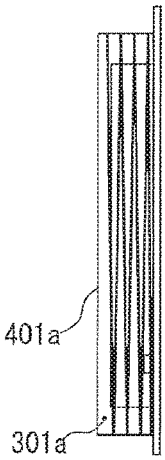
FIG. 8C is a side view of an antenna body portion in an antenna device according to a second embodiment of the present invention.
Figure 8B:
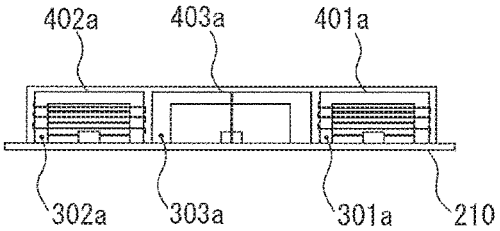
FIG. 8B is a side view of an antenna body portion in an antenna device according to a second embodiment of the present invention.

FIGS. 8A-8C are illustrations of an outer appearance of a portion of an antenna device according to the second embodiment from which a cover portion is removed. FIG. 8A is a top view, and FIG. 8B and FIG. 8C are side views thereof.

As illustrated in FIG. 8A, in the antenna device according to the second embodiment, one AM band antenna element 403*a* is arranged between two FM band antenna elements 401*a* and 402*a* so as to be side by side on an antenna mounting planar portion of an antenna base 210. An FM amplifier that is the same as that described in the first embodiment is connected to each of the FM band antenna elements 401*a* and 402*a*. Outputs from these FM amplifiers are synthesized by a synthesis circuit. Further, an AM amplifier that is the same as that described in the first embodiment is connected to the AM band antenna element 403*a*.

The FM band antenna elements 401*a* and 402*a* are formed by arranging top capacity plates at top portions of element supports 301*a* and 302*a* formed of dielectric blocks and winding linear conductors (helical coils) around frames of the element supports 301*a* and 302*a*, respectively. Further, the AM band antenna element 403*a* is formed so as to include a top capacity plate arranged at a top portion of an element support 303*a* and a linear conductor (helical coil) having one end electrically connected to the top capacity plate and another end electrically connected to a circuit board via a hollow portion in the element support 303*a*.

Each of the top capacity plates of the FM band antenna elements 401*a* and 402*a* has a long side of 100 mm and a short side of 27 mm. Further, the top capacity plate of the AM band antenna element 403*a* has a long side of 100 mm and a short side of 42 mm.

As illustrated in FIG. 5A, when each of the FM band antenna elements 401*a* and 402*a* has a height of 20 mm and the top capacity plate area of 2,700 $mm^2$, an antenna gain of one of the antenna elements is −4.5 dB. Therefore, compensation is made by 3 dB through use of two antenna elements having the top capacity plate area, and further, by 3 dB through not use of the duplexer circuit. Thus, compensation is made by 6 dB in total, and the antenna performance is higher than that of the reference antenna.

It can be seen that, also according to this embodiment, through use of a plurality of antenna elements, the antenna performance can be enhanced compared with a case in which one antenna element is used. Specifically, in an FM antenna of an antenna device 2 according to this embodiment, the area when the two antenna elements 401*a* and 402*a* each having the top capacity plate of 100 mm×27 mm are arranged side by side is 5,400 $mm^2$. As is clear from FIG. 5A, compared with an antenna gain of −3.5 dB in the case of one antenna element having a height of 20 mm with a top capacity plate having the area of 5,400 $mm^2$, the gain becomes higher by 2 dB when the total area is the same but the two antenna elements are used.

Also with regard to the antenna element 403*a* for the AM band, when the height is 20 mm and the top capacity plate area is 4,200 $mm^2$, the antenna gain exceeds +4 dB, and thus, the antenna performance can be higher than that of the reference antenna.

Further, while the antenna mounting planar portion has the area of 22,500 $mm^2$ (=150 mm×150 mm) in the antenna device 1 according to the first embodiment, in the antenna device according to the second embodiment, only the area of 10,000 $mm^2$ (=100 mm×100 mm) is necessary. Thus, in exchange for the increase in height by 10 mm, the installation space of the antenna elements can be reduced by more than a half. The antenna device according to the second embodiment is also omnidirectional in the horizontal plane.

When an antenna device having the same antenna performance is realized with the height of the antenna element being 30 mm, the installation space of the antenna elements can be further reduced.

Specifically, with reference to FIG. 5A and FIG. 5B, for example, for the FM band, by setting the top capacity plate area to 700 $mm^2$, the antenna gain becomes −4 dB. Therefore, through use of two antenna elements each having a top capacity plate of this size, the antenna gain becomes −1 dB. Through omission of the duplexer circuit, an antenna gain of 3 dB is further obtained, and thus, while securing antenna performance that is equivalent to that of the reference antenna, the installation space of the antenna elements can be further reduced.

[Third Embodiment]

Next, a third embodiment of the present invention is described. In this embodiment, there is described a case of an antenna device that can make transmission/reception in a 800 MHz band, that is, in a frequency band of from 800 MHz to 1,000 MHz in a cellular system. Names of structural elements of the antenna device and the like are similar to those in the first embodiment. The antenna device according to this embodiment is also mounted on a conductive antenna mounting plane such as a vehicle roof, and used thereon.

Figure 9:
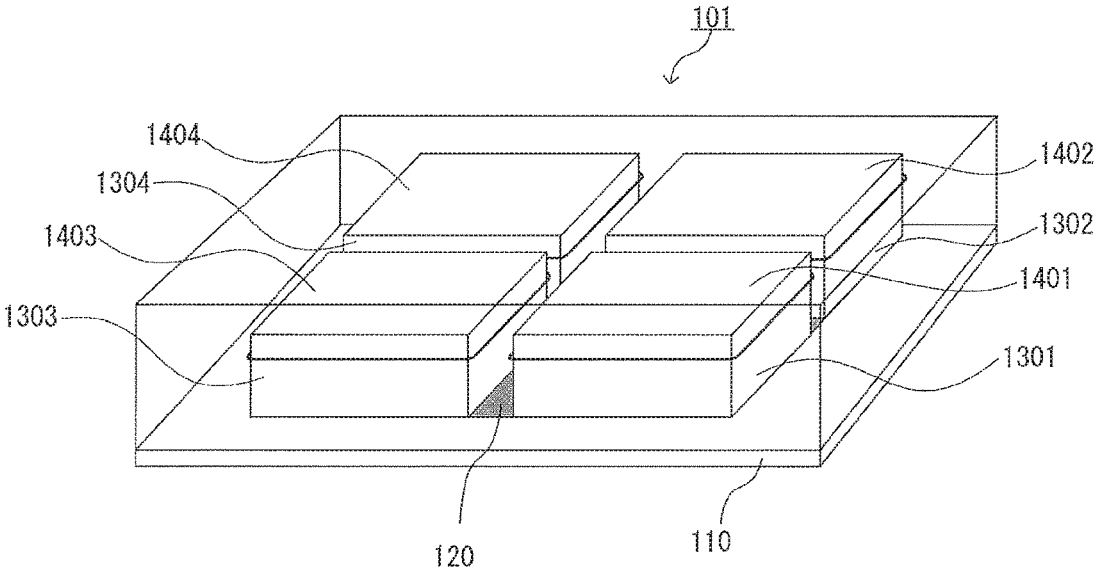
FIG. 9 is an external perspective view of an antenna device according to a third embodiment of the present invention.
Figure 10:
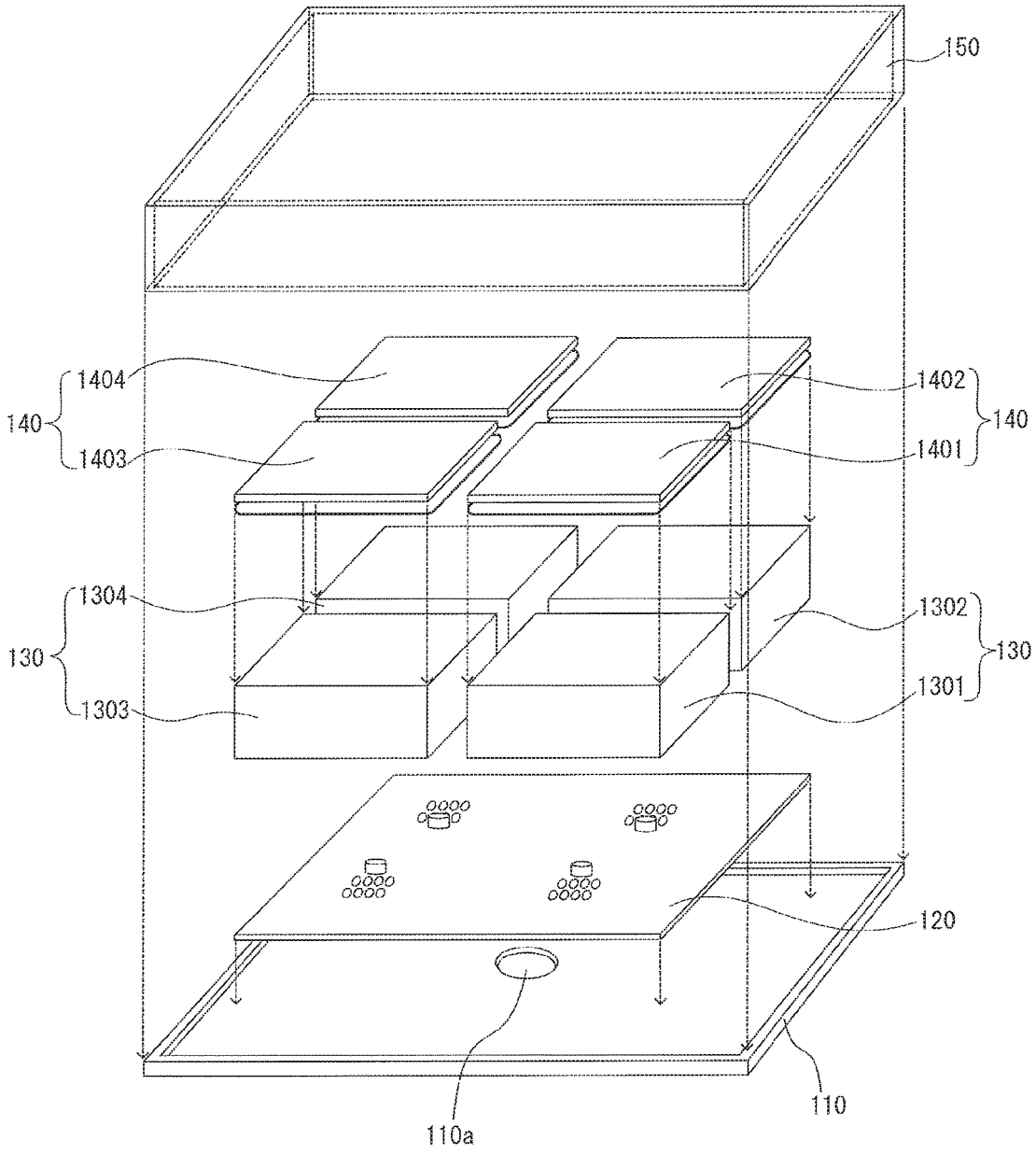
FIG. 10 is an exploded view of the antenna device according to the third embodiment.

FIG. 9 is an external perspective view for illustrating the exemplary structure of the antenna device according to the third embodiment, and FIG. 10 is an exploded perspective view thereof. An antenna device 101 includes an antenna base 110, a circuit board 120, four element supports 1301 to 1304 (referred to as element supports 130 when there is no need to distinct the element supports), four antenna elements 1401 to 1404 (referred to as antenna elements 140 when there is no need to distinct the antenna elements), and a cover portion 150. The cover portion 150 is formed of a radio wave transmitting synthetic resin.

An upper surface of the antenna base 110 has formed thereon an antenna mounting planar portion that is electrically connected to the vehicle roof to be at the ground potential in operation and a cover joining portion for watertightly joining the cover portion 150. The antenna mounting planar portion is formed so as to have the area of 900 $mm^2$ (=30 mm×30 mm) in a region that is slightly recessed from the cover joining portion on the outer periphery of the antenna base 110. The antenna mounting planar portion has a thickness of about 0.5 mm, and the cover joining portion has a thickness of about 1.0 mm.

A mounting hole 110*a* for inserting a mounting mechanism (not shown in the drawings) for mounting the antenna device 101 on a vehicle roof is formed substantially in the center of the antenna mounting planar portion. The circuit board 120 is arranged on the antenna mounting planar portion. The circuit board 120 has a thickness of about 0.5 mm.

Similarly to the cases of the first and second embodiments, each of the antenna elements 140 includes a top capacity plate and a linear conductor. The top capacity plate is formed of, for example, a copper plate having a thickness of 0.2 mm with four sides each having a length of 13 mm (having the area of 13×13 $mm^2$). The linear conductor is formed of, for example, a copper wire having a diameter of 0.1 mm and is wound several times around each of the element supports 130. One end of the linear conductor is connected to a top capacity plate in a pair, and another end thereof is connected to an antenna feeding terminal formed on the circuit board 120. Winding directions of adjacent linear conductors are opposite to each other. In this manner, currents flowing through the copper wires are in phase with each other. Thus, compared with a case in which currents in different phases flow through the copper wires, coupling between antenna elements is suppressed to suppress deterioration in antenna performance.

Each of the element supports 130 has the function of a positioning guide when the corresponding linear conductor is wound therearound, and the function of holding and fixing the corresponding top capacity plate, and is formed of a hollow dielectric block protruding in a direction perpendicular to the antenna mounting plane or the like. A height from the antenna mounting plane to the top capacity plate is about 10 mm.

The circuit board 120 is a substrate having mounted thereon transmission/reception terminals connected to the antenna elements 140, an electronic circuit including distribution/synthesis circuits configured to distribute a signal in transmission and configured to synthesize a signal in reception, and an output terminal for passing a signal to/from an external circuit. The circuit board 120 is housed in hollow portions in the element supports 130. With this, the entire size of the antenna device can be cut down.

Figure 11A:
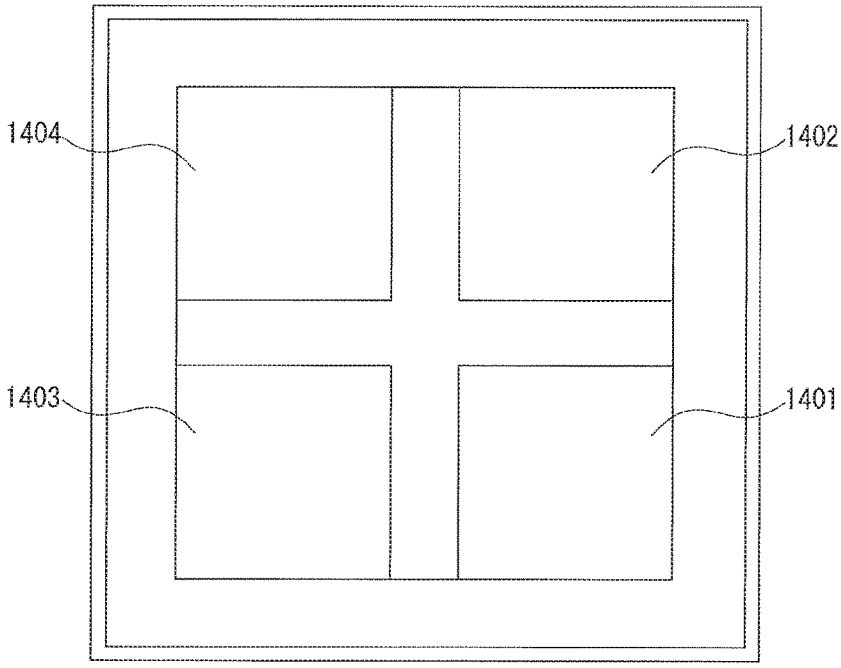
FIG. 11A is a front view of an antenna body portion in the antenna device according to the third embodiment.
Figure 11C:
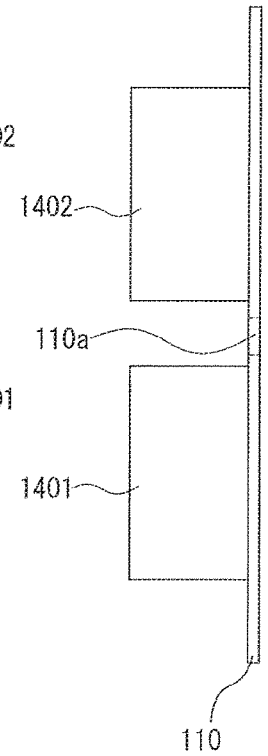
FIG. 11C is a side view of an antenna body portion in the antenna device according to the third embodiment.
Figure 11B:
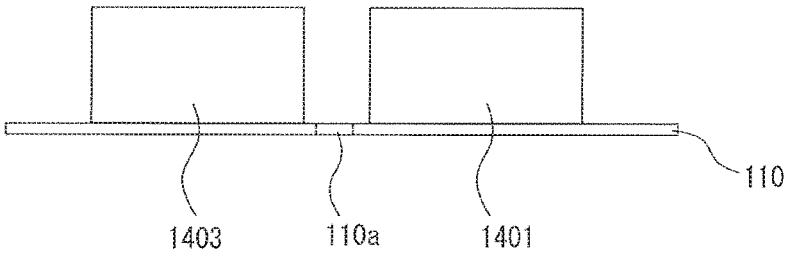
FIG. 11B is a side view of an antenna body portion in the antenna device according to the third embodiment.

FIGS. 11A-11C are illustrations of an outer appearance of an assembled antenna body. FIG. 11A is a top view, and FIG. 11B and FIG. 11C are side views thereof. As illustrated in FIG. 11A, each of the top capacity plates is a substantially rectangular flat plate, and is formed into the same shape and size as those of the top portion of the element support 130 protruding from the antenna base 110. Therefore, the top capacity plate is substantially in parallel with the antenna mounting planar portion.

Similarly to the cases of the first embodiment and the second embodiment, the top capacity plate is not necessarily required to be a rectangular flat plate, and may be in the shape of a circle, a polygon, a ring, a mesh, a combination of a ring and a lattice, or other shapes.

Further, the linear conductor is a helical coil wound around outer side surfaces of the element support 130 at predetermined intervals (pitch), and a helical diameter thereof is approximately the same as an outer diameter of the top capacity plate. In other words, the size of the helical diameter is equivalent to the top capacity plate area (area of the portion surrounded by the outer periphery thereof). The helical diameter and the pitch are adjusted so that resonance is produced at a frequency in a cellular band in the case of an antenna element for the 800 MHz band.

Next, the structures of the respective portions of the antenna device 101 having the structure illustrated in FIG. 9 to FIG. 11C are described in detail. The top capacity plate and the linear conductor are arranged as described above, and as a result, the antenna elements 140 is sized to be $13\times13\times10$ mm$^3$. Space between the antenna elements 140 is 4 mm. Therefore, the antenna mounting planar portion on the antenna base 110 has the area of 900 mm$^2$ (=30×30 mm$^2$). Further, a housing space of the entire antenna elements 140 is sized to be $30\times30\times10$ mm$^3$.

Figure 12:
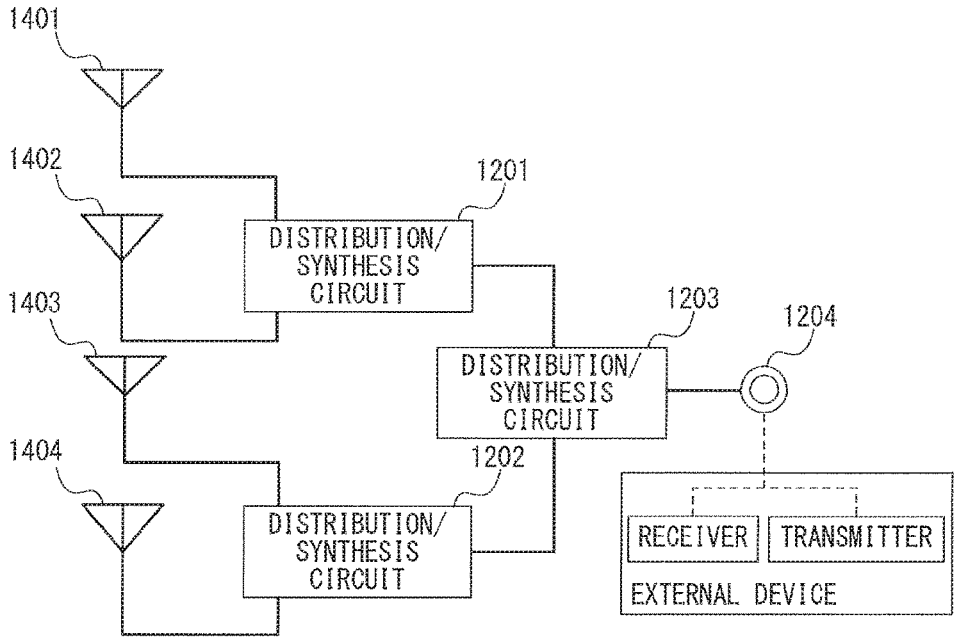
FIG. 12 is a block diagram of an electronic circuit mounted on a circuit board.

FIG. 12 is an illustration of the exemplary structure of the electronic circuit mounted on the circuit board 120. The antenna element 1401 and the antenna element 1402 are connected to a distribution/synthesis circuit 1201, and the antenna element 1403 and the antenna element 1404 are connected to a distribution/synthesis circuit 1202. Further, the two distribution/synthesis circuits 1201 and 1202 are connected to a distribution/synthesis circuit 1203. The distribution/synthesis circuit 1203 is connected to an external device including a receiver and a transmitter via an output terminal 1204.

When the antenna elements 1401 to 1404 receive signals, the distribution/synthesis circuits 1201, 1202, and 1203 synthesize these received signals and guide the synthesized signal to the receiver of the external device. The same signal is received at the same time, and thus, the antenna gain is greatly enhanced. On the other hand, when a signal is transmitted, a signal to be transmitted that is output from the transmitter of the external device is distributed to be fed to the respective antenna elements 1401 to 1404. Also in this case, the same signal is transmitted at the same time, and thus, the antenna gain is greatly enhanced.

Figure 13:
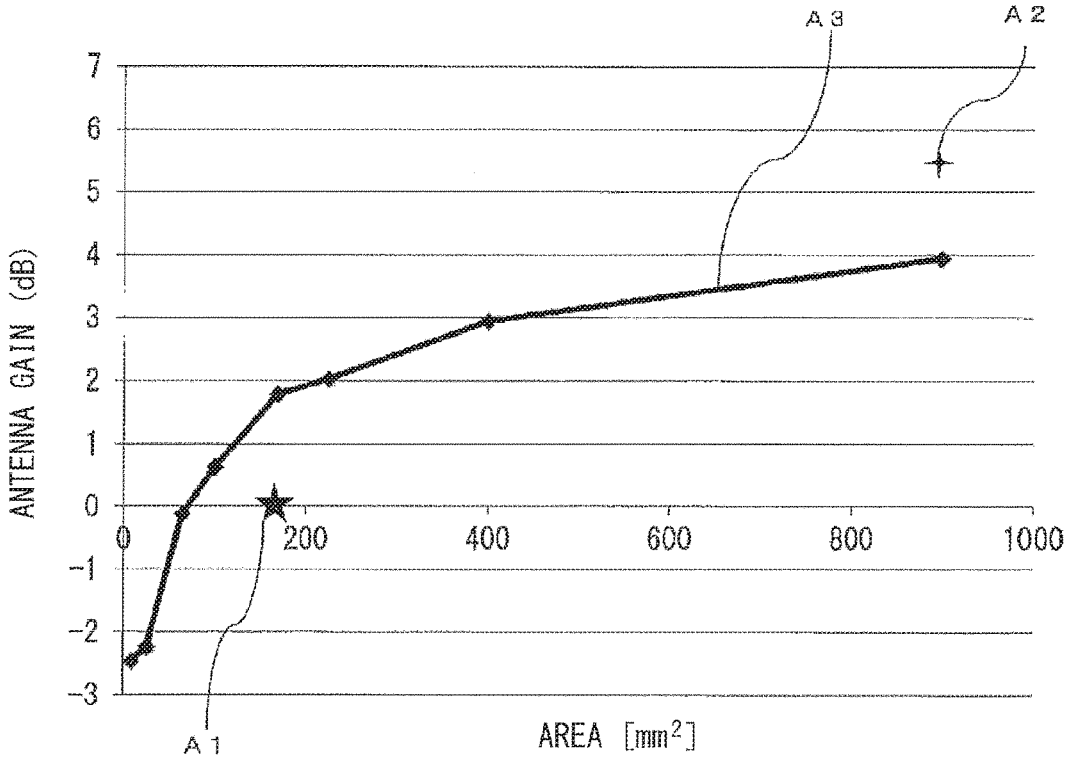
FIG. 13 is a graph for showing a relationship of antenna gains between the third embodiment and a reference antenna.

FIG. 13 is a graph for showing the relationship between the antenna gain in the 800 MHz band and the top capacity plate area. The vertical axis denotes the antenna gain dB compared with that of a reference antenna, and the horizontal axis denotes the area mm$^2$. The antenna gain dB represents an average gain in the band.

In this embodiment, the reference antenna is one helical antenna that is wound around a square having sides being 13 mm and a height of 10 mm. That is, the helical antenna is the same as the antenna element 140 from which the top capacity plate is removed.

The area of an opening for one reference antenna is 169 mm$^2$ (=13 mm×13 mm), and thus, a gain A1 thereof is used as a reference 0 dB. In FIG. 13, A2 denotes an antenna gain when four reference antennas to each of which the top capacity plate is added are arranged as illustrated in FIG. 9 to FIGS. 11A-11C, and the value thereof is 5.4 dB. A3 denotes change in antenna gain when the top capacity plate area varies with the height being maintained at 10 mm.

With reference to FIG. 13, the antenna gain of one antenna element in which the top capacity plate is added to the reference antenna is higher by about 1.8 dB. Meanwhile, it is enough that a top capacity plate of an antenna having an antenna gain equivalent to that of the reference antenna has the area of 80 mm$^2$. In other words, through addition of the top capacity plate, the antenna gain becomes higher and a wider band is attained.

Meanwhile, when the four antenna elements 1401 to 1404 each having the top capacity plate of 13 mm×13 mm are arranged side by side as in the antenna device 101 according to this embodiment, the area is about 900 mm$^2$. As is clear from A3 in FIG. 13, an antenna gain of one antenna element having a top capacity plate of 900 mm$^2$ is 4.0 dB. Thus, even with the same area, the antenna gain becomes higher by 1.4 dB when the area is divided into four to be used.

As described above, a wider band is attained also in the antenna device 101 according to the third embodiment by increasing the top capacity plate area of the antenna element, and further, dividing the same area into a plurality of pieces to be used, the antenna gain can be enhanced.

In this embodiment, a case in which the receiver of the external device amplifies in reception and the transmitter of the external device amplifies in transmission is described as an example, but these amplifiers may be arranged on the antenna device side. However, in this case, it is desired to take measures with regard to shielding of radio waves in transmission.

Figure 14:
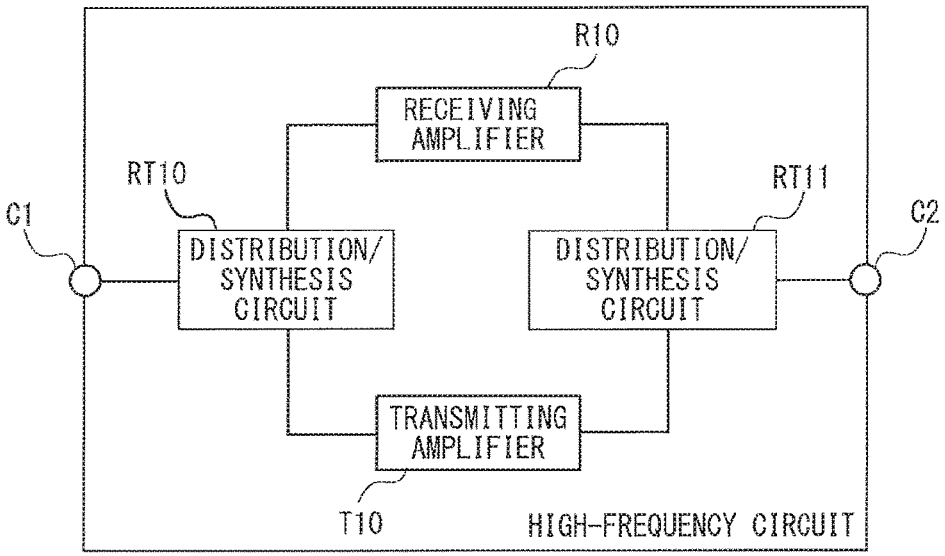
FIG. 14 is a block diagram of a high-frequency circuit.
Figure 15:
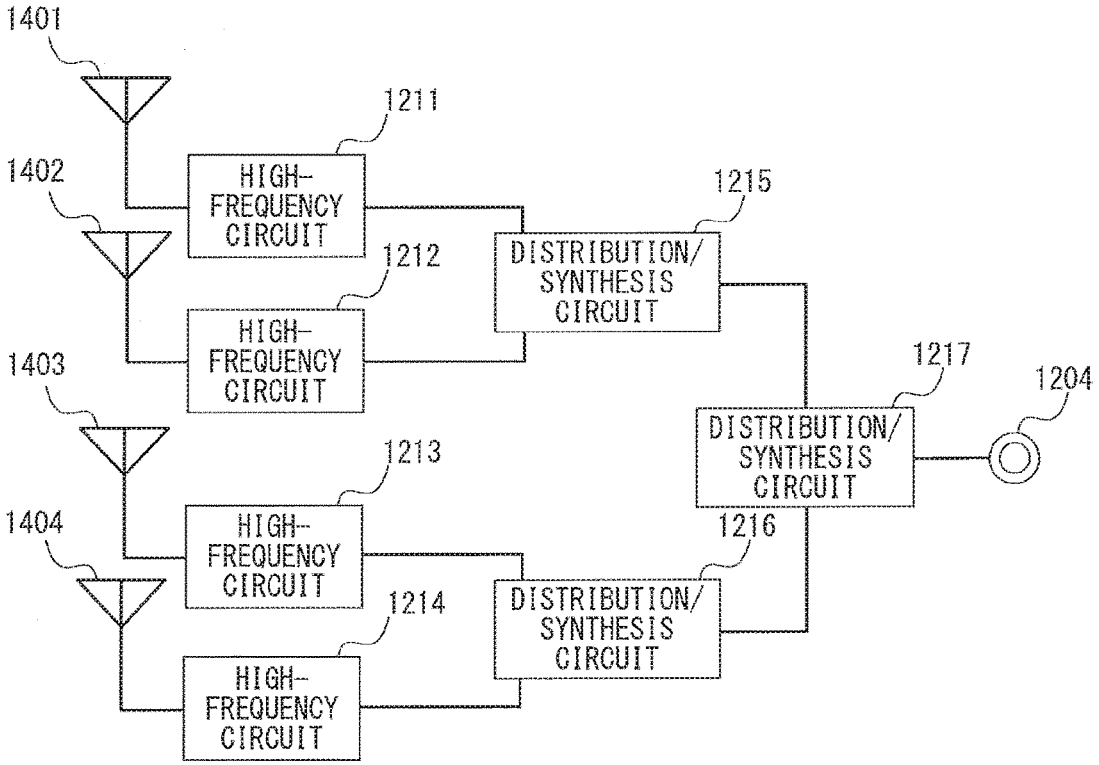
FIG. 15 is a block diagram of another electronic circuit mounted on the circuit board.
Figure 16:
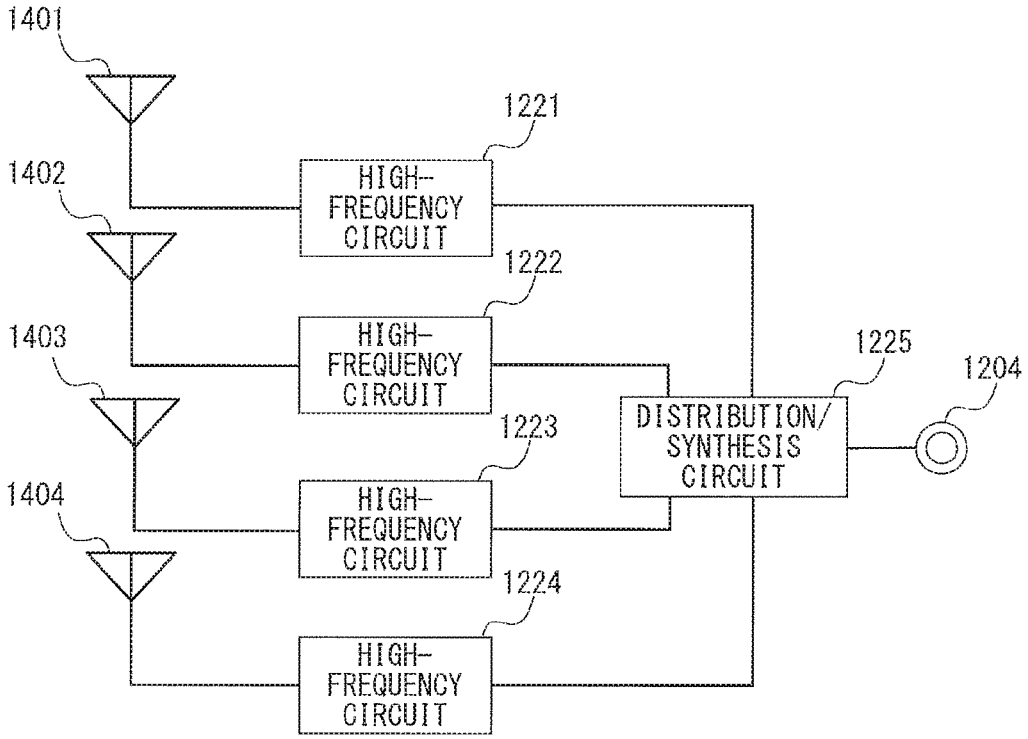
FIG. 16 is a block diagram of another electronic circuit mounted on the circuit board.

FIG. 14 to FIG. 16 are illustrations of the exemplary structure when the amplifiers are arranged on the antenna device side. When the amplification is made on the antenna device side, a high-frequency circuit having the structure illustrated in FIG. 14 is arranged. The high-frequency circuit is a circuit in which a receiving amplifier R10 and a transmitting amplifier T10 are arranged in parallel between a pair of distribution/synthesis circuits RT10 and RT11 connected to terminals C1 and C2, respectively.

FIG. 15 is an illustration of an example case in which high-frequency circuits 1211 to 1214 having the structure illustrated in FIG. 14 are arranged immediately under the four antenna elements 1401 to 1404, respectively. A distribution/synthesis circuit 1215 is connected to the high-frequency circuit 1211 and the high-frequency circuit 1212, and a distribution/synthesis circuit 1216 is connected to the high-frequency circuit 1213 and the high-frequency circuit 1214. Further, the two distribution/synthesis circuits 1215 and 1216 are connected to a distribution/synthesis circuit 1217, and this distribution/synthesis circuit 1217 is connected to the output terminal 1204 illustrated in FIG. 12.

FIG. 16 is an illustration of an example case in which the high-frequency circuits 1221 to 1224 having the structure illustrated in FIG. 14 are arranged immediately under the four antenna elements 1401 to 1404, respectively, and are connected to one distribution/synthesis circuit 1225. The distribution/synthesis circuit 1225 is connected to the output terminal 1204.

In the cases of FIG. 14 to FIG. 16, the distribution/synthesis circuits RT10, RT11, 1215 to 1217, and 1225 function as distribution circuits in transmission and function as synthesis circuit in reception.

[Modified Examples]

Three embodiments are described above, but the antenna device according to the present invention can be modified as in the following.

(1) In the first embodiment, a case is described in which the four FM band antenna elements and two AM band antenna elements are arranged side by side, and in the second embodiment, a case is described in which the two FM band antenna elements and the one AM band antenna element are arranged side by side as examples, but the numbers of the antenna elements may be different from the above. Further, only FM band antenna elements may be arranged on the antenna mounting planar portion to form the antenna device.

(2) In the first embodiment and the second embodiment, cases are described in which the amplifiers and the synthesis circuits are arranged on the circuit board 20 and 20*a* as examples. However, the circuit board 20 or the electronic circuit mounted thereon may be arranged not on the antenna base 10, 210 but on a portion other than the antenna device to be electrically connected via an interface. Further, only a synthesis circuit configured to synthesize signals in the respective frequency bands may be arranged on the circuit board 20, and a synthesized signal of received signals may be amplified by an external device of the antenna device.

(3) In the first embodiment and the second embodiment, cases of the antenna devices for the AM band and for the FM band are described, and in the third embodiment, a case of the antenna device for the cellular 800 MHz band is described as examples. However, the antenna device may include an antenna element that can receive a signal in the GPS frequency band, a frequency band for a navigation system, or a frequency band for satellite broadcasting.

[Fourth Embodiment]

Next, a method of manufacturing the antenna devices described in the first to third embodiments is described. These antenna devices can be manufactured through the following manufacturing steps. For the sake of convenience, description is made with regard to the antenna device 1 according to the first embodiment, but the same can be said with regard to the antenna devices according to the second embodiment and the third embodiment.

(1) Dividing Step

On the antenna base 10, the area of the antenna mounting planar portion in which the antenna elements can be arranged is determined. Then, the area is divided into k pieces (k is a natural number equal to or larger than 2) for the respective frequency bands, taking account of space between the elements. Specifically, taking into consideration the mutual relationship among the antenna gain, the height of the antenna element, and the top capacity plate area shown in FIG. 5A and FIG. 5B, and a gain (3 dB) that can be compensated for in the electronic circuit, the number of divisions (k) and the top capacity plate area after the division are determined from the area of the antenna mounting planar portion that can be secured.

(2) Arranging Step

After the circuit board 20 having the electronic circuit for the divided lines mounted thereon is housed on the antenna mounting planar portion, the k top capacity plates each having the divided area and the linear conductors are joined so that omnidirectionality is exhibited on a plane in parallel with the antenna mounting planar portion. In other words, the top capacity plates are joined to the element supports 30 so as to be in parallel with or substantially in parallel with the antenna mounting planar portion. One end of the linear conductor is electrically connected to the top capacity plate at a part substantially the farthest from the antenna mounting planar portion, and another end thereof is connected to the electronic circuit independently of another ends of other linear conductors.

In this manner, k antenna elements that can receive the same signal in the same frequency band at the same time are formed on the antenna base 10.

(3) Assembling Step

Finally, the cover portion is joined to the cover joining portion of the antenna base 10 to complete the antenna device 1.

REFERENCE SIGNS LIST

1, 101 . . . antenna device
10, 110 . . . antenna base
20, 120 . . . circuit board
201 to 204 . . . FM amplifier
205, 206 . . . AM amplifier
211 to 213 . . . synthesis circuit
30, 130 . . . element support
40, 140 . . . antenna element
401 to 404, 401*a*, 402*a* . . . FM band antenna element
405, 406, 403*a* . . . AM band antenna element
1401 to 1404 . . . antenna element for cellular communication
50, 150 . . . cover portion

The invention claimed is:

1. An antenna device, comprising:

an antenna base having a planar portion at a ground potential in operation; and n antenna elements, where n is a natural number equal to or larger than 2, the antenna elements being arranged on the antenna base so as to exhibit omnidirectionality on a plane in parallel with the planar portion, and being to receive or transmit the same signal at the same time, wherein each of the n antenna elements includes:

a linear conductor having both end portions arranged in directions away from the planar portion; and a planar conductor, which is electrically connected to one end portion of the linear conductor, at a part, at which the one end portion is substantially the farthest from the planar portion, and which is opposed to and substantially in parallel with the planar portion, and wherein another end portion of the linear conductor is electrically separated from another end portion of another linear conductor of another antenna element, wherein the another end portion of the another linear conductor is connected to an output portion of an electronic circuit, which is to distribute and output a signal to be transmitted, which is transmitted also from the another antenna element, wherein each of the n antenna elements is supported by a hollow frame to support the linear conductor, wherein the linear conductor is helically wound along side surfaces of the frame, wherein the planar conductor is joined to a part of the frame that is substantially the farthest from the planar portion, and wherein the electronic circuit is housed in a space surrounded by the frame.

2. The antenna device according to claim 1, wherein the linear conductor includes adjacent linear conductors helically wound in directions opposite to each other.

3. The antenna device according to claim 1, wherein the signal to be received or transmitted includes a signal in an 800 MHz band, and wherein the planar conductor of the antenna element has an area of 80 $mm^2$ or more when a height of the planar conductor from the planar portion is 10 mm.

4. An antenna device, comprising:

an antenna base having a planar portion at a ground potential in operation; and n antenna elements, where n is a natural number equal to or larger than 2, the antenna elements being arranged on the antenna base so as to exhibit omnidirectionality on a plane in parallel with the planar portion, and being to receive or transmit the same signal at the same time, wherein each of the n antenna elements includes:

a linear conductor having both end portions arranged in directions away from the planar portion; and a planar conductor, which is electrically connected to one end portion of the linear conductor, at a part, at which the one end portion is substantially the farthest from the planar portion, and which is opposed to and substantially in parallel with the planar portion, and wherein another end portion of the linear conductor is electrically separated from another end portion of another linear conductor of another antenna element, wherein the another end portion of the another linear conductor is connected to an input portion of an electronic circuit to synthesize a signal input to the electronic circuit and another signal received by the another antenna element, wherein each of the n antenna elements is supported by a hollow frame to support the linear conductor, wherein the linear conductor is helically wound along side surfaces of the frame, wherein the planar conductor is joined to a part of the frame that is substantially the farthest from the planar portion, and wherein the electronic circuit is housed in a space surrounded by the frame.

5. The antenna device according to claim 4, wherein the linear conductor includes adjacent linear conductors helically wound in directions opposite to each other.

6. The antenna device according to claim 4, wherein the signal to be received or transmitted includes a signal in an 800 MHz band, and wherein the planar conductor of the antenna element has an area of 80 $mm^2$ or more when a height of the planar conductor from the planar portion is 10 mm.

7. An antenna device, comprising:

an antenna base having a planar portion at a ground potential in operation; and n first antenna elements, where n is a natural number equal to or larger than 2, and m second antenna elements, where m is a natural number equal to or larger than 1, the n first antenna elements being to receive the same signal in a first frequency band at the same time, the m second antenna elements being to receive a signal in a second frequency band different from the first frequency band, the n first antenna elements and the m second antenna elements being arranged on the antenna base so as to exhibit omnidirectionality on a plane in parallel with the planar portion, wherein each of the n first antenna elements and the m second antenna elements includes:

a linear conductor having both end portions arranged in directions away from the planar portion; and a planar conductor, which is electrically connected to one end portion of the linear conductor, at a part, at which the one end portion is substantially the farthest from the planar portion, and which is opposed to and substantially in parallel with the planar portion, and wherein another end portion of the linear conductor of each of the n first antenna elements is electrically separated from another end portion of the linear conductor of the m second antenna elements, wherein the another end portion of the linear conductor of each of the n first antenna elements is connected to an input portion of an electronic circuit to synthesize a signal input to the electronic circuit and another signal received by another of the n first antenna elements, wherein each of the n antenna elements is supported by a hollow frame to support the linear conductor, wherein the linear conductor is helically wound along side surfaces of the frame, wherein the planar conductor is joined to a part of the frame that is substantially the farthest from the planar portion, and wherein the electronic circuit is housed in a space surrounded by the frame.

8. The antenna device according to claim 7, wherein the linear conductor includes an adjacent linear conductor helically wound in directions opposite to each other.

9. The antenna device according to claim 7, wherein the first frequency band includes an FM band and the second frequency band includes an AM band, and wherein, when a height of the planar conductor from the planar portion is 10 mm, each of the planar conductors of the n first antenna elements has an area of 3,000 $mm^2$ or more, and each of the planar conductors of the m second antenna elements has an area of 2,500 $mm^2$ or more.

10. The antenna device according to claim 7, wherein the electronic circuit further includes an amplifier having, as an amplifying element in a first stage, a semiconductor element to attain a minimum noise figure of 0.2 dB or less and an equivalent noise resistance of 4 Ω or less in a frequency band to be received.

* * * * *